US005655317A

United States Patent [19]

Grant

[11] Patent Number: 5,655,317

[45] Date of Patent: Aug. 12, 1997

[54] STUD AND WASHER SYSTEM FOR GOLF SHOE SPIKES

[76] Inventor: David F. Grant, Suite 1D 215 First Ave. NE, Calgary, Alberta, Canada, T2E 2W8

[21] Appl. No.: 607,251

[22] Filed: Mar. 4, 1996

Related U.S. Application Data

[63] Continuation of Ser. No. 181,763, Jan. 19, 1994, abandoned.

[51] Int. Cl.[6] ..... A43B 5/00

[52] U.S. Cl. ..... 36/134; 36/127

[58] Field of Search ..... 36/114, 134, 126, 36/127, 128, 129, 116, 115, 59 R

[56] References Cited

U.S. PATENT DOCUMENTS

| | | | |
|---|---|---|---|
| 1,998,921 | 4/1935 | Brown | 36/134 X |
| 2,089,459 | 8/1937 | White | 36/67 D |
| 4,330,950 | 5/1982 | Reddien | 36/127 |
| 4,470,207 | 9/1984 | Bente | 36/134 |
| 4,723,366 | 2/1988 | Hagger | 36/670 X |
| 4,922,636 | 5/1990 | Chen | 36/127 |

FOREIGN PATENT DOCUMENTS

| | | | |
|---|---|---|---|
| 0360202 | 3/1990 | European Pat. Off. | 36/134 |
| 2191677 | 12/1987 | United Kingdom | 36/134 |

*Primary Examiner*—B. Dayoan

[57] ABSTRACT

A golf spike system includes a stud having an upper portion in a generally cylindrical configuration with screw threads on its exterior surface, a lower portion having a generally cone shaped configuration, a first intermediate portion adjacent to the upper portion having a surface adapted to mate with a correspondingly shaped surface of a washer, and a second intermediate portion adjacent to the lower portion having a surface adapted to cooperatively couple with an insertion tool and a washer having an aperture therethrough, the aperture having an internal surface adapted to cooperatively receive the first intermediate portion for being rotated thereby during the coupling and uncoupling of the golf spike system with respect to a golf shoe.

1 Claim, 5 Drawing Sheets

STUD AND WASHER SYSTEM FOR GOLF SHOE SPIKES

RELATED APPLICATION

The present application is a continuation application of application Ser. No. 08/181,763 filed Jan. 19, 1994, now abandoned.

BACKGROUND OF THE INVENTION

1. Field of the Invention

The present invention relates to a golf spike system and, more particularly, to a stud and washer combination cooperatively associated whereby the stud has an external male surface adapted to be received by a similarly shaped internal female surface of a tool for attaching and releasing with respect to the sole of a golf game independent of standard female apertures and two point wrench tool.

2. Description of the Prior Art

The use of golf spikes and golf spike system are known in the prior art. More specifically, golf spikes and golf spike systems heretofore devised and utilized for the purpose of enhancing the stance of a golfer are known to consist basically of familiar, expected and obvious structural configurations, notwithstanding the myriad of designs encompassed by the crowded prior art which have been developed for the fulfillment of countless objectives and requirements.

According to the prior art, golf spikes and golf spike systems are normally of a design requiring the use of spaced apertures in a washer which may be formed integrally with or separate from the lower ground engaging portions. Note U.S. Pat. No. 4,922,636 to Chen; U.S. Pat. No. 4,783,913 to Aoyama; U.S. Pat. No. 4,667,422 to Yamaguchi; and U.S. Pat. No. 4,240,215 to Brussard. In each of these prior art structures, a two point wrench tool is employed for attaching or removing the golf spike of golf spike system from the sole of a golf shoe. Such tool requires points in the tool in combination with apertures in a portion of the golf spike or golf spike system. When playing golf, particularly on a muddy course, these holes in the spikes may become clogged thereby precluding the possibility of easy removal after extended use. In contrast, the present invention has the male portion of the coupling assembly formed in the golf spike itself. As a result, the muddy conditions need no longer be a detriment to removal of worn spikes for their replacement. Another piece of prior art is U.S. Pat. No. 3,775,874. Such spike is of an earlier design than the other patents and makes no provisions for the convenient attachment of removal of the spike from the sole of the shoe.

In this respect, the golf spike system according to the present invention substantially departs from the conventional concepts and designs of the prior art, and in so doing provides an apparatus primarily developed for the purpose of simplified construction and ease of coupling to or removal from a golf shoe sole.

Therefore, it can be appreciated that there exists a continuing need for new and improved golf spike systems which can more readily facilitate an attachment to a golf shoe or removal thereof. In this regard, the present invention substantially fulfills this need.

SUMMARY OF THE INVENTION

In view of the foregoing disadvantages inherent in the known types of golf spike systems now present in the prior art, the present invention provides an improved golf spike system construction where the same can be utilized for the more convenient replacement of used spikes as well as the addition of new spikes or removal of old spikes from the sole of a golf shoe. As such, the general purpose of the present invention, which will be described subsequently in greater detail, is to provide a new and improved golf spike system and method which has all the advantages of the prior art and none of the disadvantages.

To attain this, the present invention essentially comprises a golf spike system adapted to be releasably coupled to a threaded aperture in the sole of a golf shoe, the golf spike system comprising a stud formed symmetrically about a vertical axis, the stud having a lower portion in a downwardly extending generally conical configuration to constitute a ground engaging surface, the stud also having an upper portion in a cylindrical configuration with screw threads on its peripheral surface for releasably coupling to a threaded aperture in the sole of a golf shoe, the stud also having a first intermediate portion located between the upper and lower portions adjacent to the upper portion and formed with a corresponding star or blade shaped external periphery for coupling with a base formed with a star or blade shaped internal periphery, the stud also having a second intermediate portion between the upper and lower portions adjacent to the lower portion and formed with a rectangular external periphery for coupling with a tool formed with a corresponding rectangularly shaped internal periphery, the stud also having a central portion between the first and second intermediate portions and formed with a circular shape having a radius substantially equal to the greatest radial dimension of the first intermediate portion, the stud being formed of a steel or alternate material in one piece construction a washer formed symmetrically about a vertical axis with a central aperture therethrough, the lower extent of the aperture being circular in shape to receive the central portion of the stud, the upper extent of the aperture being star or blade shaped to receive the first intermediate portion of the stud, the washer having wrench holes in its lower face radially spaced from the aperture, the stud being fabricated of a metallic material in a one piece construction, the stud being threadably attachable to a threaded aperture of a golf shoe with the washer therebetween and with the axis of the stud being co-extensive with the axis of the washer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf spike system which has all the advantages of the prior art golf spikes and golf spike systems and none of the disadvantages.

It is another object of the present invention to provide a new and improved golf spike system which may be easily and efficiently manufactured and marketed.

It is a further object of the present invention to provide a new and improved golf spike system which is of a durable and reliable construction.

An even further object of the present invention is to provide a new and improved golf spike system which is susceptible of a low cost of manufacture with regard to both materials and labor, and which accordingly is then susceptible of low prices of sale to the consuming public, thereby making such golf spike systems economically available to the buying public.

Still yet another object of the present invention is to provide a new and improved system for golf spikes which provides in the apparatuses and methods of the prior art some of the advantages thereof, while simultaneously overcoming some of the disadvantages normally associated therewith.

Still another object of the present invention is to provide a new and improved stud and washer cooperably interrelated to constitute a golf spike system which may be more readily attached to or removed from the sole of a golf shoe.

Yet another object of the present invention is to remove golf spikes and golf spike systems from the sole of a shoe independent of clogged apertures normally functioning with a two point wrench tool.

Even still another object of the present invention is to change worn gold spikes more conveniently and rapidly.

Lastly, it is an object of the present invention to provide a golf spike system comprising a golf spike system comprising in combination a stud having an upper portion in a generally cylindrical configuration with screw threads on its exterior surface, a lower portion having a generally cone shaped configuration, a first intermediate portion adjacent to the upper portion having a surface adapted to mate with a correspondingly shaped surface of a washer, and a second intermediate portion adjacent to the lower portion having a surface adapted to cooperatively couple with an insertion tool; and a washer having an aperture therethrough, the aperture having an internal surface adapted to cooperably receive the first intermediate portion for being rotated thereby during the coupling and uncoupling of the golf spike system with respect to a golf shoe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
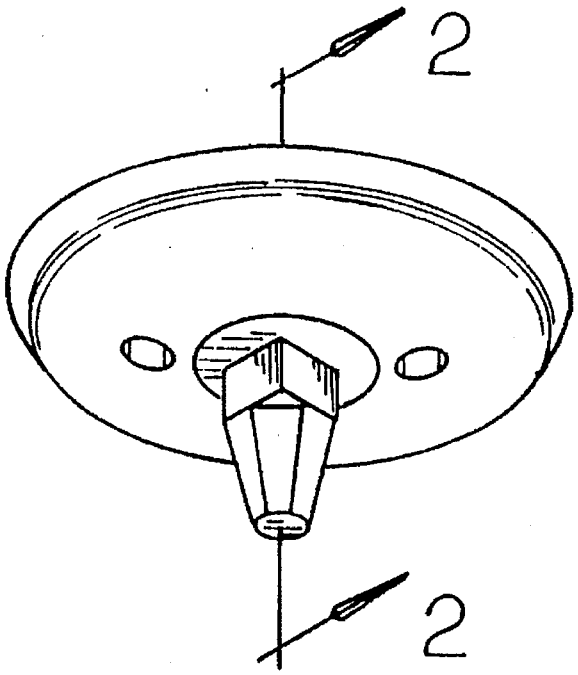
FIG. 1 is a perspective illustration of a golf spike system constructed in accordance with the principles of the present invention.

With reference now to the drawings, and in particular to FIG. 1 thereof, a new and improved golf spike system embodying the principles and concepts of the present invention and generally designated by the reference numeral 10 will be described.

More specifically, it will be noted that the golf spike system 10, when constructed in accordance with the primary embodiment of the invention, is fabricated of two parts, a stud 12 and a washer 14. The parts cooperate one with another and are adapted to be releasably coupled together and also coupled with respect to a threaded aperture 18 in the sole of a golf shoe 20.

The lower portion 25 of the stud has a downwardly extending external surface which is generally conical in configuration. It should be understood that any shaped lower portions including those known in the prior art could be readily utilized so long as they provide the function of a secure footing for a golfer when making a shot, with the lower portions of the stud extending into the ground.

The upper portion 26 of the stud 12 is generally cylindrical in configuration. Its peripheral exterior surface is formed with screw threads. The screw threads are of a size to be releasably received through threaded engagement with respect to female screw threads formed in the lower surface of a sole of a golf shoe 20 in a standard manner.

This stud 25 also contains two intermediate portions 34 and 32. The upper intermediate portion 34 according to the preferred embodiment includes a star shaped region with a plurality of rectangular bearing surfaces on it. The purpose of this upper intermediate portion is to be received by similarly shaped star shaped aperture through the washer 14 as will be later described. Because of the cooperable shapes in these regions of the stud and washer, rotation of the stud 12 during insertion of a system into the sole of the shoe or its removal will effect the rotation of the washer 24.

The second intermediate portion 32 is located adjacent to the lower portion of the stud. The lower intermediate portion has a rectangular configuration forming four rectangular bearing surfaces. These bearing surfaces are for cooperable interaction with an internal rectangularly shaped surface of a tool to be employed during the attachment of such system to the sole of a golf shoe or its removal.

The last portion of the stud is a central portion 38 formed in a circular configuration. The radius of the central portion is essentially equal to the greatest radial dimension of the star shaped intermediate portion 34. The circular portion functions to hold the washer upwardly against the sole of a shoe when in use. This is effected by the upper surface of the central portion 38 Contacting the radially inward regions of the star shaped part of the washer 24.

The second element of the system is the washer 24. The washer is formed symmetrically about a vertical axis and is adapted to be co-extensive with a vertical axis of the stud 12 when the system is positioned for use on the sole of a golf shoe. The washer has a central aperture 42 extending therethrough. The lower extent 44 of the aperture is circular in shape for receiving the circularly shaped central portion 38 of the stud 12. This cooperable relationship, as described above, maintains the washer 24 in position during operation and use of the system. The upper extent 46 of the aperture 42 is star shaped corresponding to the star shaped upper intermediate portion 34 of the stud 12. As described above, the cooperable relationship of these elements is to effect rotation of the washer 24 concurrent with the rotation of the stud 12. The washer 24 has wrench holes 48 in its lower face spaced radially outwardly from the central aperture 42. Such wrench holes 48 are provided in the event that a user may wish to use a standard two point wrench tool for replacing the golf spike system 10. It is preferred, however, that the exposed lower intermediate portion 32 be used for coupling with a special tool or adapter as described hereinafter. By using such special tool or adapter, there is less likelihood of problems in spike replacement since the action of replacement is not adversely affected by clogged wrench holes 48.

The stud 12 is preferably formed of a one piece construction from steel coated with a thin layer of zinc for appearance and durability. The washer 14 is preferably fabricated of a plastic material for greater wearability during prolonged usage. The washer can also be colored for aesthetic purposes. Together the washer and stud are approximately 30 percent lighter than any equivalent system.

Figure 2:
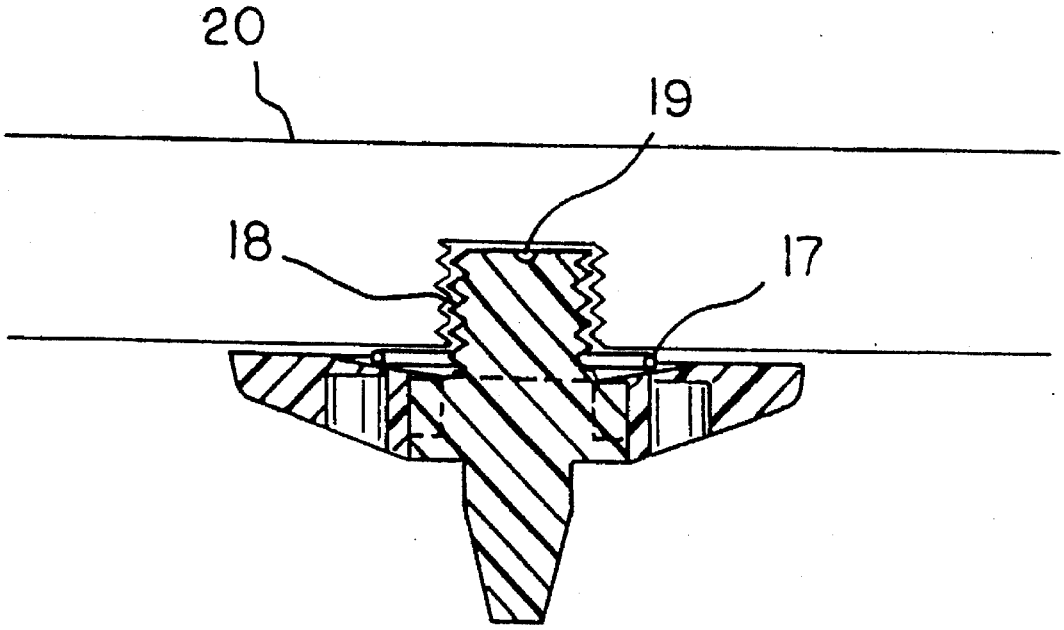
FIG. 2 is a sectional view of the system as shown in FIG. 1 taken along line 2—2 of FIG. 1.
Figure 3:
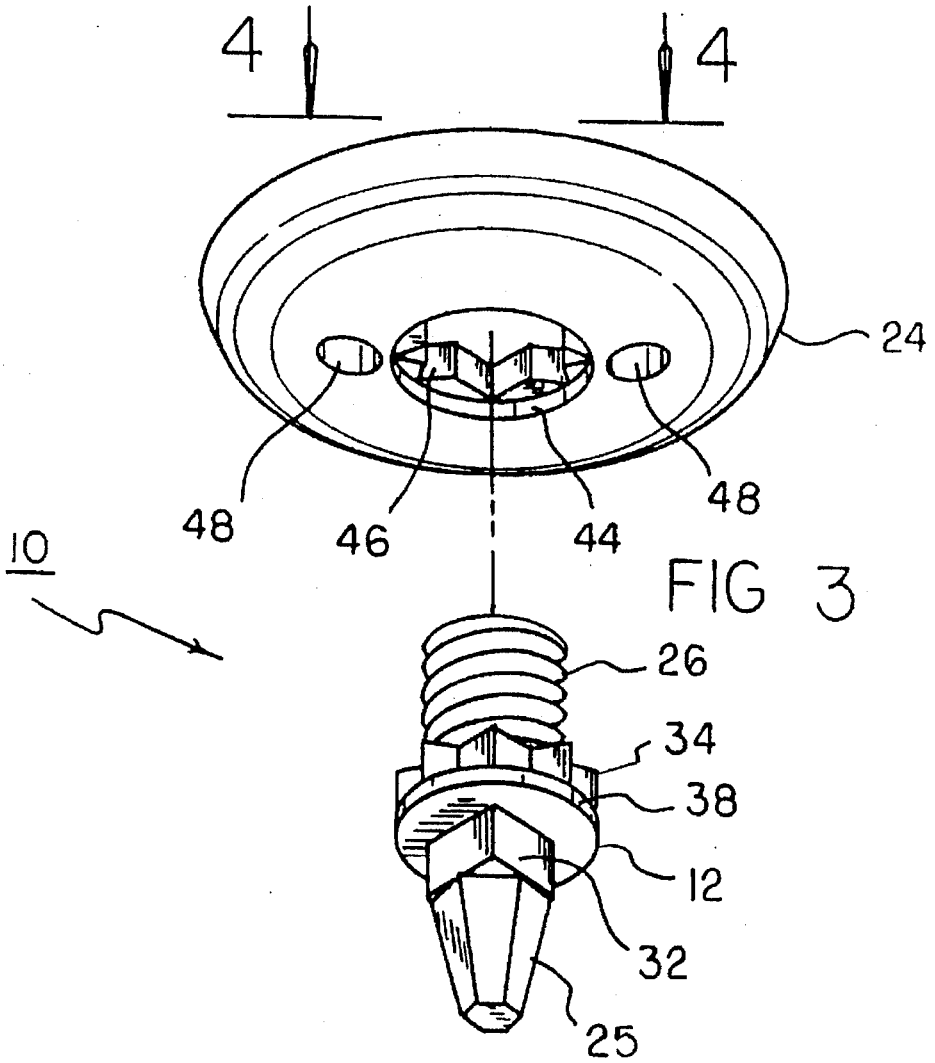
FIG. 3 is an exploded perspective view of the golf spike system of FIG. 1 and 2.
Figure 4:
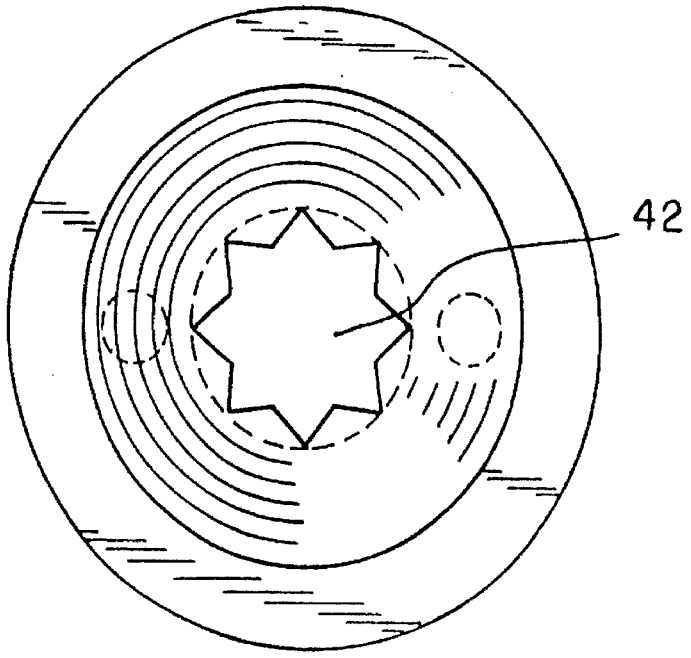
FIG. 4 is a bottom view of the washer shown in FIGS. 1, 2 and 3 taken in the direction of arrows 4—4 of FIG. 3.

Two Additional features extend the utility. First, a waterproof bead 17 is provided in the upper surface of the washer. Note FIG. 2. Such bead is located near the upper extremity of the washer to provide a waterproof seal against the bottom of the golf shoe 20. In addition, a small dimple 19 is formed in the upper side of the stud 12. Note FIG. 2. The dimple provides for lubricant storage to prevent the rusting of the spike into the shoe 20.

Figure 5:
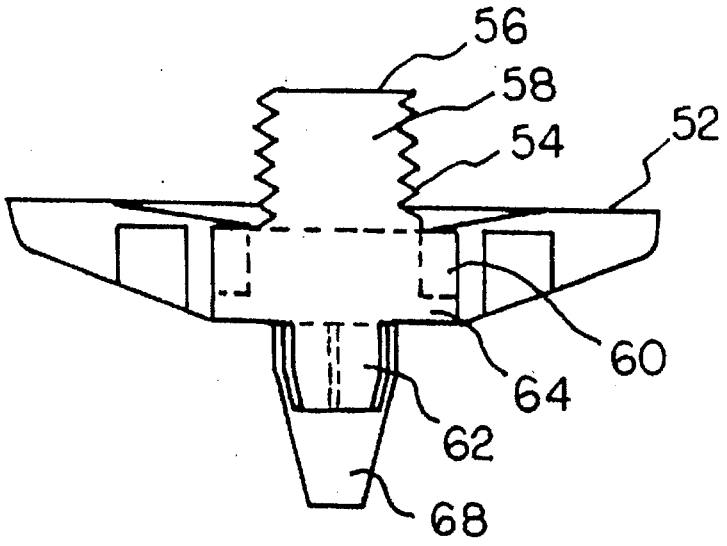
FIG. 5 is a sectional view of a golf spike system similar to FIG. 2 but illustrating an alternate embodiment of the invention.
Figure 6:
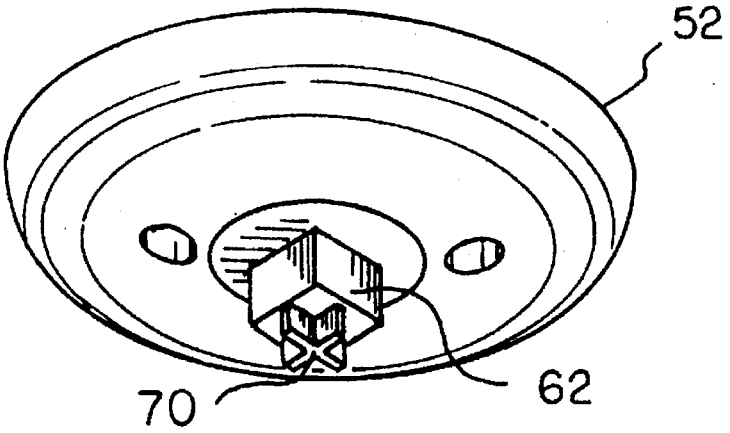
FIG. 6 is a perspective view of a golf spike system similar to FIG. 1 that shows the FIG. 5 alternate embodiment of the invention but with the cap removed.

An alternate embodiment of the invention is shown in FIGS. 5 and 6. According to that alternate embodiment, the washer 52 is fabricated to that of the primary embodiment. The stud 54, however, is fabricated of two parts. The Upper part 56 is fabricated with an upper portion 58, two intermediate portions 60 and 62 and a central portion 64 are fabricated of steel as in the primary embodiment. However, the lower part 68 or cap is formed separately either of a durable plastic or of a metal material. It is attached to the upper part 56 of the stud. Coupling is strengthened by having a downwardly extending cross shaped member 70 extending downwardly from the lower intermediate portion 62. When the cap 68 is sufficiently worn through prolonged use, it will be worn away and the cross shaped element 70 will become exposed as an indicator that repair of the system is needed. Such repair is done simply by replacing the cap 68 rather than the throwing away of the entire system simply because the cap 68 has become worn.

Figure 7:
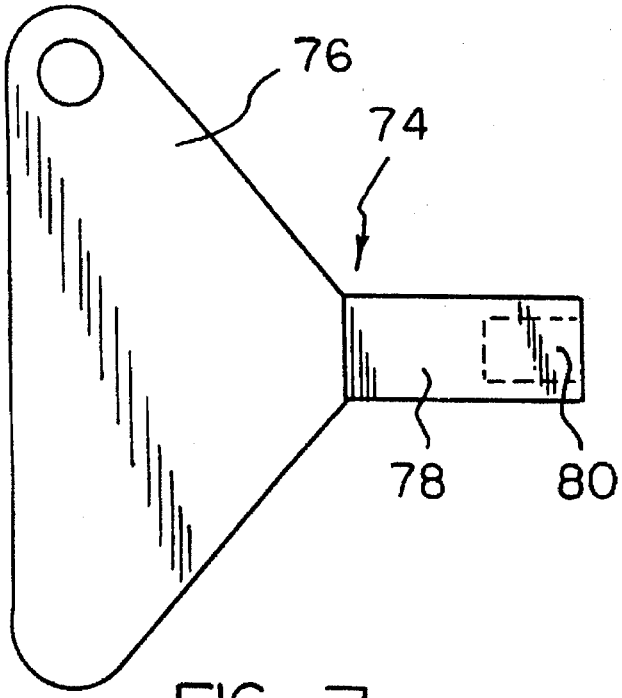
FIGS. 7 and 8 are plan and side elevational views of a tool for use with the golf spike system of the prior Figures.
Figure 8:
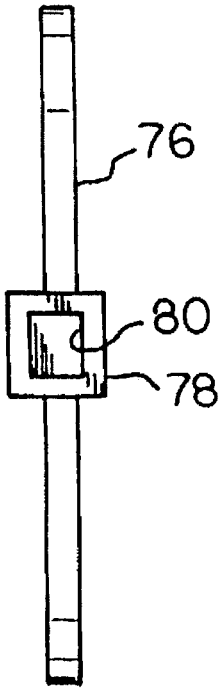

FIGS. 7 and 8 illustrate a tool 74 for replacement of spikes, the addition of a new spike or the removal of an old spike. The tool 74 has a handle 76 readily grasped by the player or person charged with care of the shoe. Downwardly extending is a projection 78 having an inwardly extending recess 80. The recess 80 is formed with four similarly shaped rectangular faces adapted to receive the corresponding four rectangular faces 32 of the stud immediately above the lower portion 24. When so inserted, the handle 76 can be turned in a clockwise direction for removing a worn spike. With such an arrangement, there is no need for a conventional two point wrench tool for having its projections extend into the apertures of the golf spike or golf spike system as in the prior art.

Figure 9:
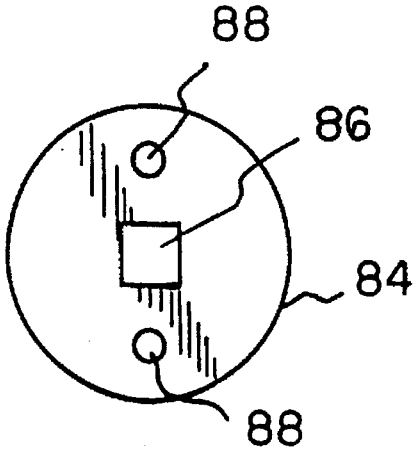
FIGS. 9 and 10 are a side and front elevational view of an adapter for use in association with the golf spike system of the prior Figures but for use in association with a standard two point wrench tool.
Figure 10:
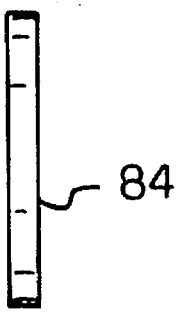

The last element of the system is shown in FIGS. 9 and 10. Such element constitutes an adapter 84 for use in association with a standard two point wrench tool, not shown. When the adapter 84 is used, it is formed with a rectangular central opening 86 and two spaced apertures 88 for the prongs of an insertion tool of a standard design. The central rectangular aperture is placed over the rectangular faces 32 of the lower intermediate portion of the stud. A standard two prong tool is then inserted through the apertures 88 for rotating the adapter 84 and golf spike system through clockwise rotation for insertion of the system and counterclockwise rotation for removal of the system. The adapter can also be press fit to standard two prong tool.

Figure 11:
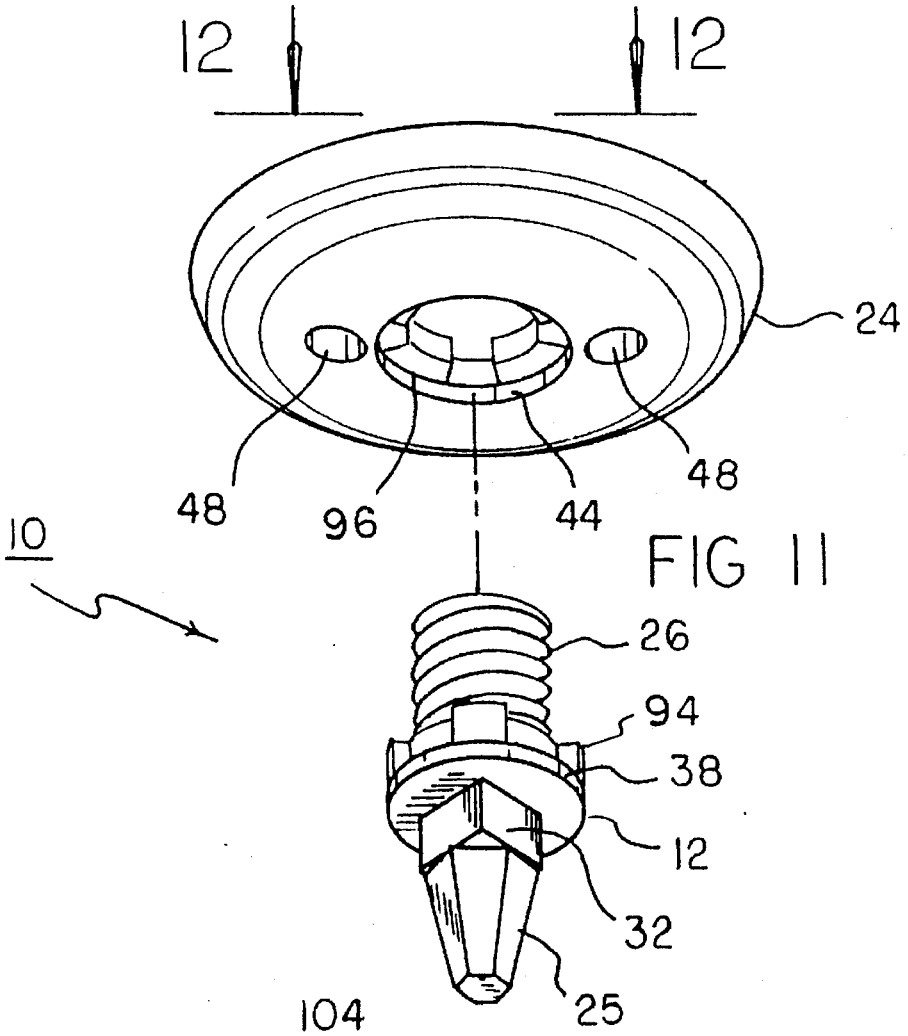
FIGS. 11 and 12 are illustrations similar to FIGS. 3 and 4 but showing another alternate embodiment of the invention.
Figure 12:
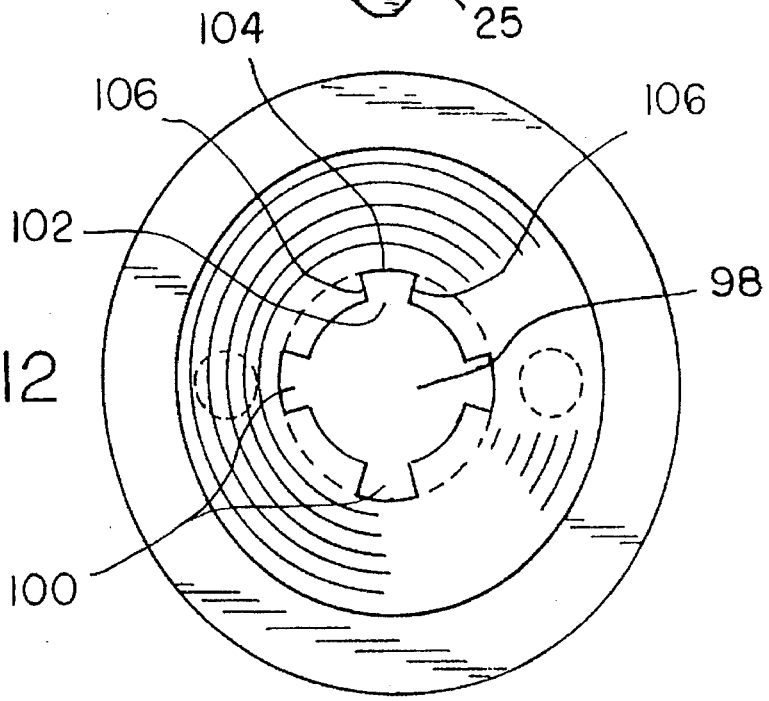

Shown in FIGS. 11 and 12 is another alternate embodiment of the invention. In such embodiment, the star shaped intermediate portion 34 of the prior embodiment is configured as a blade shaped intermediate portion 94. Further, the star shaped upper extent 46 of the aperture 42 is configured as a blade shaped upper extent 96 which corresponds in size and shape to the intermediate portion 94 with which it mates.

The blade shape of the extent 96 of this embodiment includes a central circular part 98 and four radially extending parts 100. The radially extending parts 100 are generally trapezoidal in shape with an exterior edge 104 of a wide construction, an interior edge 102 of a narrow construction and tapering side edges 106 therebetween.

Parts 100 may be considered blades which provide greater surface areas between the intermediate portion and upper extent, with greater strength where needed, when screwing in the stud or screwing it out.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf spike system adapted to be releasably coupled to a threaded aperture in the sole of a golf shoe, the golf spike system comprising:

a stud formed symmetrically with a vertical axis, the stud having a lower portion in a downwardly extending generally conical configuration to constitute a ground engaging surface, the stud also having an upper portion in a cylindrical configuration with screw threads on its peripheral surface for releasably coupling to a threaded aperture in the sole of a golf shoe, the stud also having a first intermediate portion located between the upper and lower portions adjacent to the upper portion and formed with a geometrically shaped external periphery having radially extending components of a first height, the stud also having a second intermediate portion between the upper and lower portions adjacent to the lower portion and formed with a rectangular external periphery for coupling with a tool formed with a corresponding rectangular shaped internal periphery, the stud also having a central portion between the first and second intermediate portions and formed with a circular shape having a radius substantially equal to the size of the first intermediate portion, the stud being formed of steel in a one piece construction; and a washer formed symmetrically with a vertical axis with a central aperture therethrough forming an upper axial extent and a lower axial extent, the lower extent of the aperture being circular in shape to receive the central portion of the stud, the upper extent of the aperture extending entirely through the washer and being geometrically shaped to receive the first intermediate portion of the stud the upper extent of the aperture housing having a height essentially equal to the first height, the washer having wrench holes in its lower face radially spaced from the aperture, the stud being threadably attachable to a threaded aperture of a golf shoe with the washer therebetween and with the axis of the stud being co-extensive with the axis of the washer.

* * * * *